US005083787A

United States Patent [19]

Petre

[11] Patent Number: 5,083,787

[45] Date of Patent: Jan. 28, 1992

[54] COMBINATIONAL LOGIC SYSTEM

[76] Inventor: Marian Petre, 1240 A The Queensway, Etobicoke, Ontario, Canada, M8Z 1S2

[21] Appl. No.: 530,138

[22] Filed: May 25, 1990

[51] Int. Cl.[5] ..... A63F 3/08

[52] U.S. Cl. ..... 273/148 R; 273/138 R; 273/139; 273/148 A

[58] Field of Search ..... 273/138 R, 138 A, 139, 273/141 R, 141 A, 142 R, 142 H, 142 HA, 143 R, 144 R, 144 A, 144 B, 145 R, 146, 147, 148 R, 148 A

[56] References Cited

U.S. PATENT DOCUMENTS

| | | | |
|---|---|---|---|
| 4,239,226 | 12/1980 | Palmer | 273/146 |
| 4,403,775 | 9/1983 | Chaput | 273/144 B |
| 4,444,294 | 4/1984 | Pasquine | 273/144 B |
| 4,545,578 | 10/1985 | Stagg, Jr. | 273/144 B |
| 4,586,710 | 5/1986 | Beam | 273/138 A |
| 4,600,198 | 7/1986 | Fox | 273/144 R |
| 4,665,502 | 5/1987 | Kreisner | 364/900 |
| 4,674,748 | 7/1987 | Wismer | 273/141 R |
| 4,688,797 | 8/1987 | Sebestyen | 273/148 R |
| 4,692,863 | 1/1988 | Moosz | 364/412 |
| 4,712,796 | 12/1987 | Reiss | 273/148 R |
| 4,721,309 | 1/1988 | Miesel | 273/148 R |

*Primary Examiner*—William H. Grieb

[57] ABSTRACT

A scheduling aid is provided that permits extremely rapid selection of a required number of combinations from a given field of choice, as a logic process enhancement. The scheduling aid can be operated in regards to numbers, such as making lottery selections or for making up work schedule and similar organizational activities. In the matter of lottery number combinations the system makes possible the generation of a total or a partial series of combinations of a predetermined number of choices from a predetermined field of numbers. Conversely, the system also lends itself to the rapid checking of winning ticket combinations from a plethora of such tickets. Unlike known prior art devices the system permits simultaneous combination selections from a plurality of individual fields, being usable at rates exceeding those achievable even with a computer.

13 Claims, 3 Drawing Sheets

COMBINATIONAL LOGIC SYSTEM

FIELD OF THE INVENTION

This invention is directed to a system of operation and a scheduling aid for formulating combination selections from a predetermined larger field of choice.

BACKGROUND OF THE INVENTION

The scientific selection of combinations from a field of choice yields a mathematical series for which formulated tables are available.

There are numerous uses to be made of combination selections such as arranging duty rotation rosters of a selected number of shift workers from an available field of eligible workers, so as to ensure fair rotation of the workers in a shift or in statistical research selecting sets of subjects from a large population.

Another, and much more widespread field of activity is in the selection of numbers for lottery tickets. Such selections are frequently carried out on a random basis. The use of mathematical combinational analysis enables systematic choices to be made, increasingly considerably the chances to obtain a prize.

The legalization of lotteries has become widespread, on the North American continent and elsewhere. In formulating lottery tickets on a systematized basis it is fairly usual to select a limited field of numbers, possibly chosen at random, within the scope of the lottery. From this elected field a predetermined number of "picks", as specified for that lottery is required for each lottery ticket that is to be completed.

As an example, in a "6/49" Lottery each ticket comprises a combination of six different numbers, selected in the range 1 through 49. Evidently, the total number of combinations of six numbers to be formulated between 1 and 49 runs into millions of combinations (13,983,816), it being practically impossible to complete such a large number of tickets even if the cost can be covered.

Selecting a preferred field of, say, twelve numbers from the available 49 numbers vastly reduces the total number of potential combinations, and brings such activity into a logistic and financial area of feasibility.

The elected field of say twelve numbers is then combed so as to give all possible combinations from the field, 924 for the specified number of picks, in this instance six, that forms each combination. Each combination is then entered on a respective ticket. Entering all combinations of six numbers from a chosen field of 12 numbers gives the guarantee that when all six winning numbers are among the chosen twelve, the highest prize will be awarded along with many other cash prizes. This complete combination of 12 numbers representing 924 combinations or groups or sets of six is commonly called 6 of 6. The following table shows minimum required numbers of tickets to ensure coverage for a specific combination form (reduced) and what is required for the correspondent minimum prize guaranteed.

| Prize Group | | | Nos. of tickets to be entered on play |
|---|---|---|---|
| Guaranteed Prize | | Winning Nos. among Nos. played | |
| 3 | of | 6 | 4 |
| 3 | of | 5 | 6 |
| 3 | of | 4 | 6 |
| 3 | of | 3 | 15 |
| 4 | of | 6 | 6 |

-continued

| Prize Group | | | Nos. of tickets to be entered on play |
|---|---|---|---|
| Guaranteed Prize | | Winning Nos. among Nos. played | |
| 4 | of | 5 | 18 |
| 5 | of | 6 | 68 |
| 5 | of | 5 | 132 |
| 6 | of | 6 | 924 |

In carrying out this operation, a number of aids have been previously available. Certain of these aids comprise random number generators; others include combination formulators.

From a search in the classified art the following listed U.S. patent references are considered to be of varying relevance to the present invention, being listed arbitrarily in numerical sequence, and not by relevance. The asterisked Reiss patent U.S. Pat. No. 4,712,796 is considered the most relevant.

U.S. Pat. No. 4,239,226, December 1980
U.S. Pat. No. 4,403,775, September 1983
U.S. Pat. No. 4,444,394, April 1984
U.S. Pat. No. 4,545,578, October 1985
U.S. Pat. No. 4,586,710, May 1986
U.S. Pat. No. 4,600,198, July 1986
U.S. Pat. No. 4,665,502, May 1987
U.S. Pat. No. 4,674,748, June 1987
U.S. Pat. No. 4,688,797, August 1987
U.S. Pat. No. 4,692,863, September 1987
U.S. Pat. No. 4,712,796, December 1987
U.S. Pat. No. 4,721,309, January 1988

Using the approach of a reduced field, the available number combinations can be mathematically derived by combinational analysis, as derived from scholarly sources ranging from "Arithmetica Practica" Herigone 1634 A.D. (now out of print) to "The VNR Concise Encyclopedia of Mathematics", page 577 published by Van Nostrand Reinhold Company 1977 A.D.

In the noted Reiss patent (U.S. Pat. No. '796) a single field of numbers can be dealt with at any time, using a rotary slide rule type of mechanism.

Another approach, using an appropriate mathematical table as referenced above and giving each selected actual number a sequential reference digit, then the combinations of reference digits for a field of given size, and for a pick of given extend, can be readily formulated from selected reference tables. The actual numbers then are substituted for the corresponding reference digits obtained from the combinational table, to yield the desired collection of combinations, which then can be individually transcribed onto lottery tickets. It will be seen that this is time consuming, tedious and boring, and is open to error, in view both of the transcription and the number-to-digit substitution that is necessary in such an operation.

The system disclosed in U.S. Pat. No. 4,712,796 comprises a mechanical device for providing combinations of six numbers selected from a field of twelve arbitrarily chosen numbers, with a guarantee prize of 4 of 6. This device may be used only one line at a time, such that both in making selections for the preparation of tickets, and in checking tickets for winning combinations, the operation can only be carried out for a single field at a time, which is exceedingly slow and tedious, as each cycle of operation requires erasure of the previous field and entry of a new, 12-digit field.

In accordance with the present invention a great number of alternative fields can be chosen and entered in a device at one time and the possible combinations for each field can be read off directly, one line at a time for each field, with the device being merely re indexed one line at a time, and the field re-read.

In another embodiment, a device is presented which allows the user to select any number of combinations from a large variety of fields.

In this concept the selector cards become united in a film transported against the field card, using a very simple indexing mechanism.

SUMMARY OF THE INVENTION

The present invention provides a method of selecting non-recurrent combinations of a predetermined number of integers selected from a plurality of fields of choice, each field containing a larger number of pre-selected integers than is selected for a respective combination, the method comprising the steps of using a pre-formulated mathematical grid pattern based upon mathematical combinational logic for unspecified integer combinations having the same size of fields and same number of integers to be selected; selecting a series of dissimilar integers from a predetermined limiting range of integers, to form the plurality of fields of choice; and, sequentially selecting respective ones of the field integers in accordance with the mathematical grid pattern.

While the foregoing enunciated method may be used for combining integers of different types as previously referred to, in the preferred embodiment the integers comprise numbers, generally of one or two digits, generally selected from an overall range of limited, predetermined extent. In one given example, see above, the range is from one to forty nine, each combination comprising an assembly of six single or double digit numbers. In a preferred embodiment of the present invention the pre-formulated mathematical grid pattern provides blanking indicia means, and serves to mask off the space on the respective field occupied by numbers that do not form part of the respective combination.

In a further embodiment the preformulated mathematical grid pattern provides indicating indicia means to directly identify the members of a field to be selected, to form the instant combination. These indicia means may comprise an arrow head or an encompassing ring to highlight a selected square of the grid, and any number inscribed therein.

In accordance with the presently disclosed method the plurality of fields from which the combinational choice is made are arranged in regular patterns of lines and/or columns, and the mathematically formulated grid pattern also is arranged in correspondingly regular patterns of lines and/or columns, and is displaceable, rectilinearly, parallel with the lines or with the columns of the respective fields and grid pattern.

The present invention provides a combination selection device having at least one line for the entry of a predetermined number of elements as a field of choice therein; elongated selector indicia means movable linearly past the field, having a predetermined index providing sequentially varying, individually patterned selector index lines to yield a different combination of an elected number of elements for each line of the index, when in registry with the field.

In a preferred embodiment the present invention provides a plurality of entry lines, each to receive a field of elements entered therein, the entry lines being mutually spaced at intervals coincident with the spacing of the selector indicia lines, so as to provide coincidence between field entry lines and selector index lines whereby a plurality of combinations are readable for each line to line setting of the selector indicia means relative to the field.

In one embodiment the entry lines for separate fields are arranged in mutually superposed columnar relation on a substantially planar surface, having the lines of field figures extending laterally thereacross, the selector indicia means having index lines thereof extending parallel with the field lines, being transversable therepast in a direction normal to the field lines, so as to bring respective selector index lines into sequential registry with the respective field lines.

In another embodiment, a device is presented which allows the user to select any number of combinations from a large variety of fields.

In this concept the selector cards become united in a film transported against the field card, using a very simple indexing mechanism.

The present invention provides a card device on which a large plurality of fields may be entered. In addition to utilizing the device for obtaining simultaneous combinations from a plurality of fields, field entries may be made on the card of the device, one line at a time, with the preceding weeks of selected fields being left recorded, for reference purposes, in which case the lowermost entered field line or lines of numerals would be currently operated upon for its respective possible combinations.

It will be understood, being somewhat self evident, that increasing the size of the field selected from the total potential lottery field, and playing a higher guaranteed prize group of combinations in the selected field, will lead, mathematically to an increased chance in successfully picking several winning combinations.

One preferred embodiment of the invention comprises a substantially pocket sized base card in combination with one or more selector indicia slides of like size to the base card. As the higher guarantee prize group is selected for a pick of six numbers in a field of sixteen numbers exceeds the capacity of a single selector slide, a series of such slides is provided, each marked in accordance with mathematically predicated combinations.

In addition to use in generating a range of possible combinations, which may be in the form of selections of six numbers from a field of ten numbers, with a guaranteed prize of 4 of 6 thus providing entry lines for four tickets; or six numbers selected from a field of eleven numbers, with the same prize guarantee 4 of 6 so as to provide entry lines for six tickets, etc., etc., the device in accordance with the present invention also may be used in checking previously formulated tickets against a winning lottery line, as issued by the lottery organizers. Thus, by suitably identifying on the previously entered field numbers, as by colour highlighting with a colour marker these numbers declared to be winning numbers in the subject lottery, then by re-application of the selector indicia to the highlighted field rapid identification may be made of these tickets containing three or more of the winning numbers, which would qualify for a prize in accordance with many lottery systems.

Using the present invention, the extremely labour intensive, error prone prior systems for preparing lottery tickets and subsequently comparing them with winning numbers is superseded by an easy to use, and rapid system for such preparation or comparison work.

BRIEF DESCRIPTION OF THE DRAWINGS

Certain embodiments of the invention are described by way of illustration, and without limitation of the invention thereto, reference being made to the accompanying drawings, wherein.

DETAILED DESCRIPTION OF THE DRAWINGS

Figure 1:
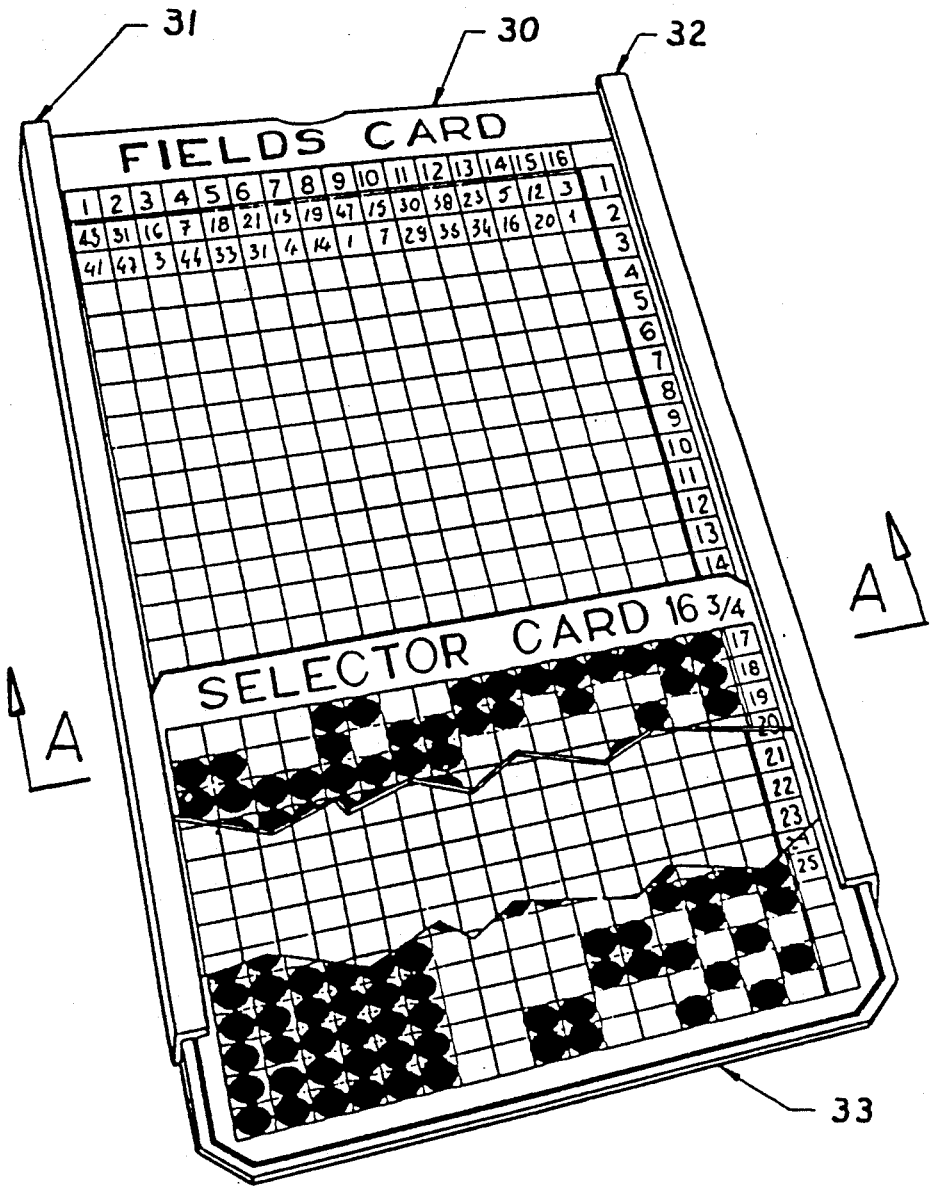
FIG. 1 is a perspective view of a device in accordance with the present invention.
Figure 2:
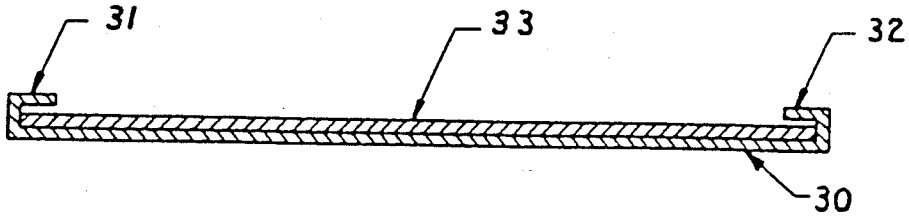
FIG. 2 is a section taken at A—A of FIG. 1.

Referring to FIG. 1 of the illustrated embodiment of the device comprises a purse sized plastic "field card" 30 having inturned edge portions 31, 32 that form a slide way, in which a plastic indicia selector card 33 is slidably inserted, as seen in FIG. 2.

The field card 30 is illustrated as having sixteen numbered columns numbered sequentially laterally across the field card, and arranged in upwards of twenty-five superposed rows numbered sequentially downwardly in the right hand margin of the field card, as illustrated.

Row number 1 and row number 2 are illustrated as having handwritten portions of selected numerical fields written thereon. All of the field rows may be thus marked, at the initiative of the user. To that end, the upper surface of the plastic field card 30 is treated to accept erasable pencil markings.

The pre-printed selector card 33 generally is of substantially the same size as the field card 30, and fits snugly in the slide way formed by edge portions 31, 32, for ready longitudinal relative displacement therein.

The number of indicia squares of each row of the selector card 33 correspond with the number of squares of the columns of the field card 30.

The pre-printed selector card 33 comprises clear plastic, through which the field numbers written on the card 30 may be read, or having an indicia mark obscuring the underlying field number. Thus, in the case of a selector card 33 marked for combination of six numbers (i.e. six "picks" per line) there is provided six clear viewing panels in pre-arranged sequence, in accordance with the combination logic being used in the system. The balance of numbers for each field is obscured by an opaque marking on the selector card 33.

In manufacturing the cards a protective barrier is applied thereon, to resist ultraviolet depredation of the plastic.

As the logic for a required field of say sixteen numbers readily exceeds a convenient size for the selector card 33, a series of such cards, containing the desired sequence of combinations is provided.

In use, the selector card 33 is moved upwardly until the first i.e. uppermost row thereof is superposed over the lowermost inscribed row of the field card 30. The six unobstructed numerals inscribed on field card 30 are then read, and transcribed to a ticket, as a six combination entry.

The selector card 33 is moved upwardly by one line, bringing the indicia of two lines thereof in overlying relation with the two lowermost lines of the field card, and having a new indicia combination overlying the previously read, lowermost field line of card 30. The two new six numbered combinations then are read, and transcribed to two further tickets.

The selector card 33 is then moved upwardly by one line, to cover three field card lines, and a further three new combinations transcribed therefrom onto a further three tickets. The number of combinations thus progressively increase.

Figure 3:
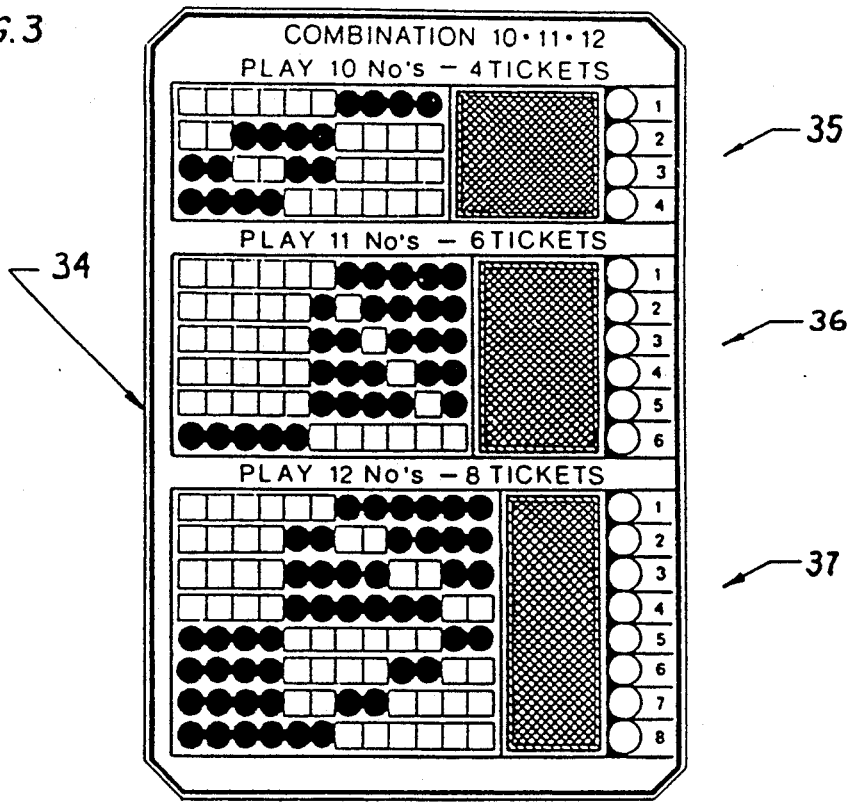
FIG. 3 shows a compound combination selector for three different sizes of field.

Referring to FIG. 3, this shows an selector card 34, suitable for use with the field card 30. The selector card 34 has a top segment 35; middle segment 36 and lower segment 37.

The top segment 35 has on each line ten windows, of which six are clear, for use with reduced fields of ten numerals. Used with a single field line of ten numbers, four combinations and hence four tickets, each having one entry line can cover the guaranteed prize of 4 of 6 of the restricted field.

The middle segment 36 has eleven windows for each line, of which six are clear, for use with a field or fields of eleven numerals. For a single line field, this translates into six six-number combinations and six tickets, for a guaranteed prize of 4 of 6.

The bottom segment 37 has twelve windows for each line of which six are clear, for use with a field or fields of twelve numerals, leading to eight tickets for a single line field, for a guaranteed prize of 4 of 6.

Figure 4:
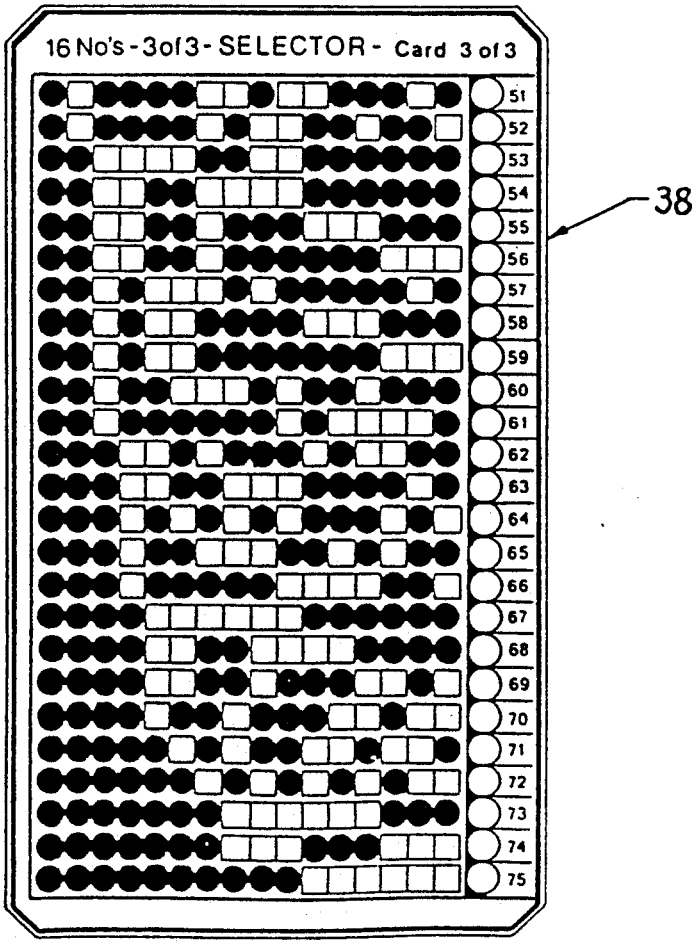
FIG. 4 shows the third one of a series of three combination selectors totaling 75 possible combinations.

Referring to FIG. 4, the indicator card 38, also for use with the field card 30, has a full sixteen numeral coverage, being the third indicator card of a series of three such cards, totaling seventy five combinational lines, as indicated in the right hand index column, to give a guaranteed prize of 3 of 3.

While the FIG. 1 embodiment is purse sized, it will be evident that physical size can be readily increased, to accommodate more numbers, as shown on FIG. 4.

Figure 5:
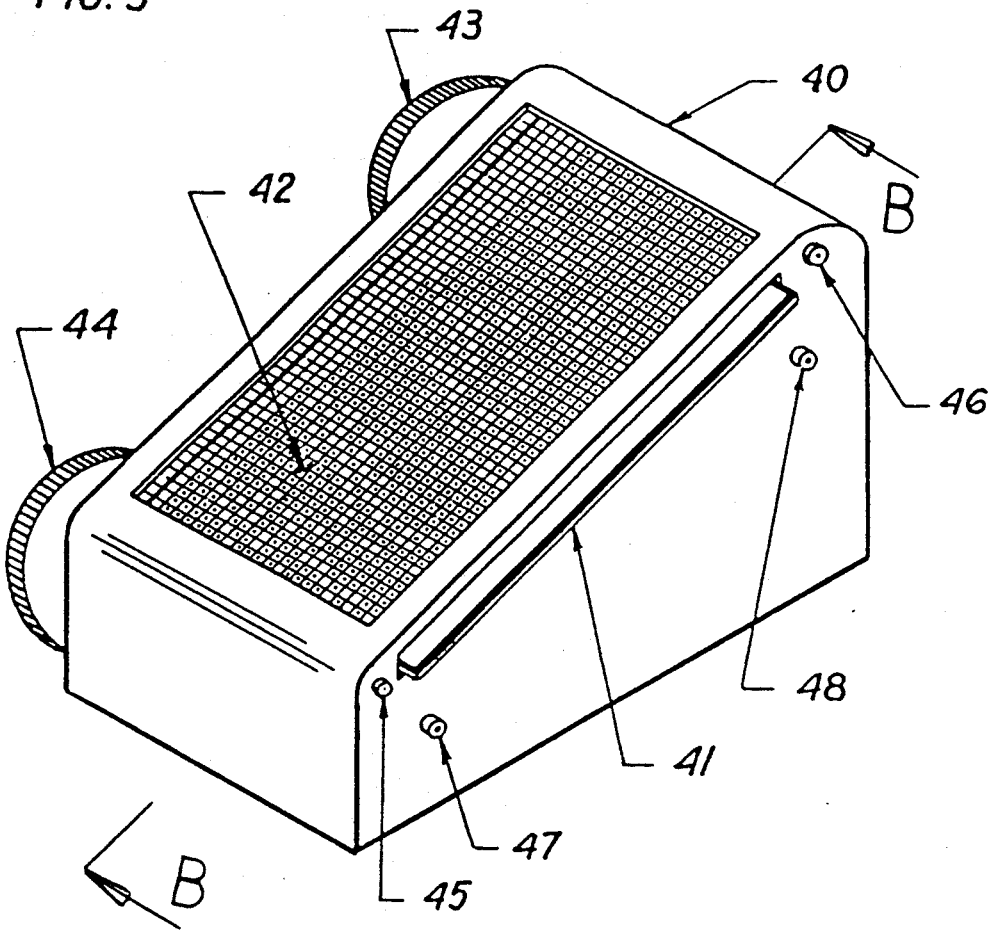
FIG. 5 shows a perspective view of a machine for viewing selector films.
Figure 6:
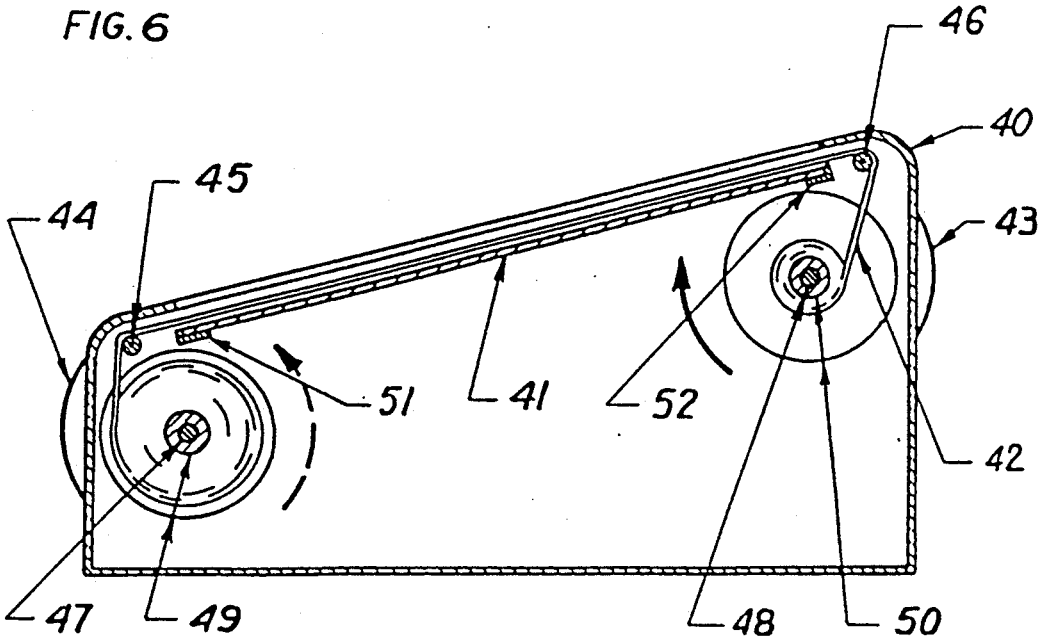
FIG. 6 is a section taken along line B—B of FIG. 5.

Referring to FIG. 5, a device 40 with an upper opening revealing a selector film 42 which is rolled onto a drum or cylinder 49 and transported longitudinally over the rollers 45, 46 to the receiver drum 50.

The field card 41 comprises a large number of individual field cards, inserted side by side in the space provided under the selector film 42, being supported by the brackets 51 and 52.

The drum roller handle 43 is used to index the selector film in one direction. Complete rolling of the film exposes many reduced combinations sets of many prechosen fields, there being no need to recharge the drum roller 49 to start a new operation. The handle 44, rotated in the reverse direction can now be used to index the film in the opposite direction. The operation can continue until all desired field cards are used.

Consequently there need be no requirement for singular or independent templates which process the same combination tables encoded on them. This device would contain (i.e.) all 12 number combinations offering 3 of 3, 3 of 4, 3 of 5, 3 of 6, 4 of 4, 4 of 5, 4 of 6, 5 of 5, 5 of 6 and 6 of 6totaling 924 combinations.

In addition to using the presently described devices as a logic process enhancement for combinational generation, to assist in the rapid formulation of non-recurrent combinations from at least one predetermined field of choice, the devices also can be used in order to identify those previously formulated tickets that contain a predetermined minimum number of a number combination announced to be the winner of the lottery. In this instance, onto the previously prepared fields, containing three or more of the announced winning numbers, those numbers of the field announced as being winners, are visually identified by colour highliner, or conversely the non-winning numbers are canceled or otherwise identified as may be appropriate to the method in use. The reapplication of the relevant indicator card with which the lottery tickets had been prepared immediately makes visually evident these combinations containing three or more of the winning numbers, being thus eligible for a prize.

It will be understood that the present invention is susceptible of change, within the scope of the following claims.

I claim:

1. The method of directly generating sets of interrelated combinations containing a predetermined selected number of integers, said integers being non-recurrent numbers from a range of numbers, from a plurality of fields of choice, each field containing a large number of non-recurrent integer numbers than said predetermined selected number, comprising the steps of using a preformulated mathematical grid pattern having a sequence of lines, each line being individually patterned based upon mathematical combinatorial logic for unspecified integer combinations having the same size of fields and the same number of integers to be selected; selecting a series of dissimilar integers to formulate said fields of choice in mutually adjoining relation and having a predetermined spatial relationship; and sequentially selecting respective ones of said field integers in accordance with said mathematical grid pattern, to provide a non-recurrent series of related combinations of said integers from said fields wherein when three or more numbers are matched in any of said fields, then the presence of said three or more numbers in one or more of said lines will be ensured and also be readily and rapidly visually detected.

2. The method as set forth in claim 1, said mathematical grid pattern including indicators to indicate which of said numbers comprise a said combination.

3. The method as set forth in claim 1, said mathematical grid pattern serving to conceal predetermined ones of said numbers, said method including the step of reading those numbers of said field not concealed by said pattern.

4. The method of directly generating sets of combinations containing a predetermined number of integers, said integers being non-recurrent numbers from a range of numbers selected from a plurality of fields of choice, each field containing a larger number of non-recurrent integers numbers than said predetermined selected number, comprising the steps of using a preformulated mathematical grid pattern based upon mathematical combinatorial logic for unspecified integer combinations having the same size of fields and the same number of integers to be selected; selecting a series of dissimilar integers to formulate said fields of choice, arranged in mutually adjoining relation and having a predetermined spatial relationship; and sequentially selecting respective ones of said field integers in accordance with said mathematical grid pattern by displacing said grid pattern indicia in successive registry with said plurality of fields, to provide a non-recurrent corresponding plurality of combinations of said integers from said fields.

5. The method as set forth in claim 4, said plurality of fields being located in respective rows, said rows being in mutual spaced relation in aligned columns of numbers.

6. The method as set forth in claim 4, said mathematical grid pattern being formulated in respective rows in spaced relation corresponding to said fields in aligned columnar relation; said grid pattern displacing step comprising sliding said grid pattern in a direction parallel with said columns, one row at a time to progressively cover said fields; and reading a new said combination from each said covered field, for each row displacement of said grid pattern.

7. The method as set forth in claim 4, at least some of said fields being in aligned relation in a said row, in laterally spaced columns; said mathematical grid pattern being correspondingly arranged; said step of displacing said grid pattern including moving the grid pattern rectilinearly parallel with said rows, to traverse said indicia laterally in succeeding registry with said fields.

8. A combinational aid for selecting as non-recurrent mathematical combinations, a predetermined number of different individual elements from element fields each containing a number larger than said predetermined number, of different individual elements, comprising:

field sheet means for entering said fields in predetermined field spatial relationship;

selector indicia sheet means having indicia markings thereon spatially arranged for sequential indicative correspondence with respective ones of said fields; and rectilinear guide means to guide displacement of said selector means in sequential registry with said fields, to enable the progressive reading of said mathematical combinations from said fields.

9. The aid as set forth in claim 8, said field sheet means having a plurality of lines in spaced relation to receive said field elements in entered relation thereon in respective columns, said lines and columns constituting the major axes of said field sheet.

10. The aid as set forth in claim 9, said rectilinear guide means extending parallel with one of said major axes.

11. The aid as set forth in claim 8, said rectilinear guide means comprising a pair of opposed borders of said field sheet means.

12. The aid as set forth in claim 8, for selecting combinations of numbers, said field sheet means being substantially pocket sized and having lines and columns on a face thereof for entering selected fields limited within a predetermined range; and a like sized selector sheet slidable in guided relation over the face of said field sheet, said indicia markings comprising opaque areas to obscure selected portions of said lines and columns, to reveal predetermined other areas in accordance with said mathematical combinations.

13. The aid as set forth in claim 8, having a series of field lines in laterally extending relation; said selector indicia sheet means extending laterally, for lateral displacement relative to said field lines; and means for displacing said selector sheet means in selective displacement past said field lines.

* * * * *